US006003631A

United States Patent [19]

Knauth

[11] Patent Number: 6,003,631

[45] Date of Patent: Dec. 21, 1999

[54] WALL SUPPORTED SCAFFOLDING DEVICE

[76] Inventor: Peter R. Knauth, 1104 Friedensburg Rd., Reading, Pa. 19606

[21] Appl. No.: 09/162,561

[22] Filed: Sep. 29, 1998

[51] Int. Cl.[6] ..... E04G 3/00

[52] U.S. Cl. ..... 182/82; 182/150

[58] Field of Search ..... 182/82, 87, 90, 182/92, 130, 150; 248/235

[56] References Cited

U.S. PATENT DOCUMENTS

| | | | |
|---|---|---|---|
| 5,259,477 | 11/1993 | Fears et al. | 182/82 |
| 5,503,358 | 4/1996 | Lapp | 182/82 X |
| 5,524,727 | 6/1996 | Yennie, Jr. et al. | 182/82 |
| 5,615,751 | 4/1997 | Snow | 182/82 |
| 5,638,917 | 6/1997 | Vennen | 182/150 |

*Primary Examiner*—Daniel P. Stodola
*Assistant Examiner*—Hugh B. Thompson
*Attorney, Agent, or Firm*—Henderson & Sturm

[57] ABSTRACT

A wall supported scaffolding device (10) for suspension and attachment to the upper portion of a wall panel (100) wherein the device (10) includes an inverted T-shaped vertical support member (20) provided with a plurality of generally C-shaped brackets (22) dimensioned to pivotally receive the inboard ends of a cross piece member (30) and an angled brace member (40). The outboard ends of the cross piece member (30) and the brace member (40) support a railing support unit (14) and wherein the intermediate portion of the cross piece member (30) is provided with a locking bolt (37) for preventing the lateral displacement of a scaffold plank (200) long the longitudinal axis and/or transverse to the longitudinal axis of the cross piece member (30).

8 Claims, 3 Drawing Sheets

WALL SUPPORTED SCAFFOLDING DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of wall supported scaffold devices in general, and in particular to a collapsible and detachable scaffold device.

2. Description of Related Art

As can be seen by reference to the following U.S. Pat. Nos. 5,259,477; 5,503,358; 5,524,727; and 5,615,751, the prior art is replete with myriad and diverse wall supported scaffolding constructions.

While all of the aforementioned prior art constructions are more than adequate for the basic purpose and function for which they have been specifically designed, they are uniformly deficient with respect to their failure to provide a simple, efficient, and practical ruggedly constructed scaffold device that can easily and quickly be assembled and disassembled on site to assist roofers and framers in the performance of this appointed tasks.

As most individuals in the construction trades are all too well aware, the need for stable ruggedly constructed scaffolding is an absolute necessity both for the safety and welfare of the workers, but also to facilitate the performance and completion of a variety of different tasks.

As a consequence of the foregoing situation, there has existed a longstanding need for a new and improved type of wall supported scaffolding device having a structurally reinforced main vertical support member and various other stability enhancing features, and the provision of such a construction is a stated objective of the present invention.

BRIEF SUMMARY OF THE INVENTION

Briefly stated, the wall supported scaffolding device that forms the basis of the present invention comprises in general, a vertical support unit, a lateral support unit extending outwardly from the vertical support unit, a brace unit extending between the vertical support unit and the lateral support unit and a railing support unit extending upwardly from the lateral support unit.

As will be explained in greater detail further on in the specification, the vertical support unit comprises a generally inverted T-shaped vertical support member having a plurality of vertically spaced generally C-shaped brackets disposed along the vertical stem portion of the vertical support member. The C-shaped brackets form reinforced anchor points for the inboard ends of both the lateral support unit and the brace unit wherein the brackets project beyond the sides of the vertical support member, so that the lateral support unit and the brace unit are not connected directly to the stem portion of vertical support unit per se.

In addition, the scaffolding device is also provided with stabilizing means both for affixing the vertical support unit to a wall panel and for preventing the lateral displacement of scaffolding planks along two axis relative to the lateral support unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
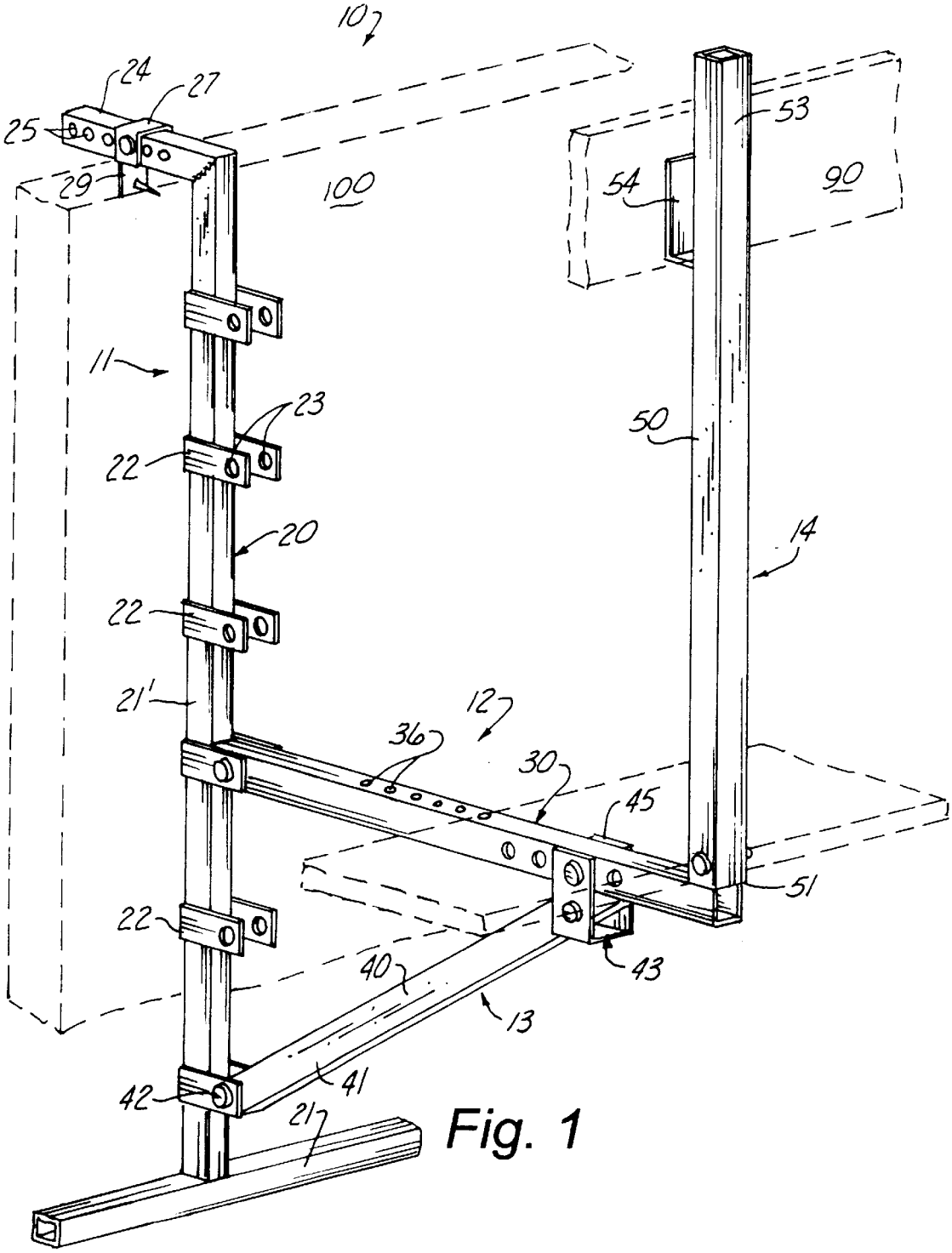
FIG. 1 is a perspective view of the wall supported scaffolding device that forms the basis of the present invention.

As can be seen by reference to the drawings, and in particularly to FIG. 1, the wall supported scaffolding device the wall supported scaffolding device that forms the basis of the present invention is designated generally by the reference number 10. The device 10 comprises in general, a vertical support unit 11, a lateral support unit 12, a brace unit 13, and a railing support unit 14. These units will now be described in seriatim fashion.

Figure 2:
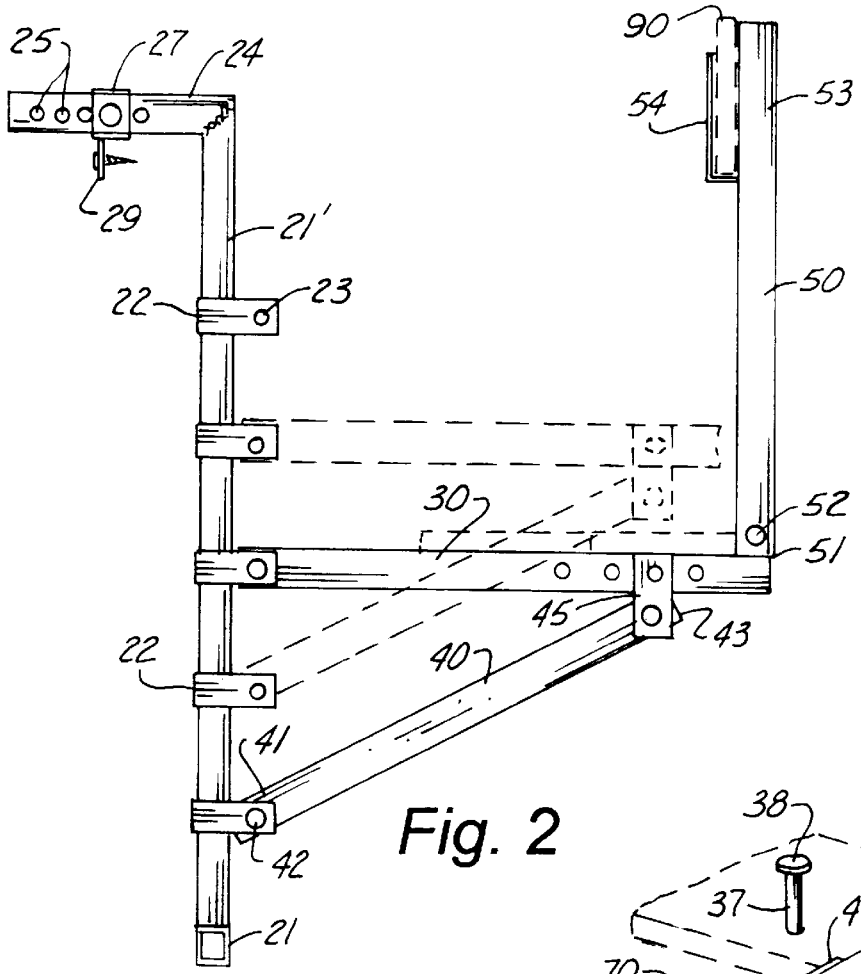
FIG. 2 is a side plan view of the device.

As shown in FIGS. 1 and 2, the vertical support unit 11 comprises a generally inverted T-shaped vertical support member 20 having an elongated horizontal cross piece 21, and a vertical stem portion 21' provided with a plurality of vertically spaced generally C-shaped brackets 22 having opposed apertures 23 disposed on the outboard ends of the individual brackets 22.

In addition, as shown in FIGS. 1, 2, 4, and 5, the upper end of the vertical stem portion 21' of the vertical support member 20 is further provided with a rearwardly extending leg portion 24 provided with a plurality of apertures 25 which are dimensioned to receive a first locking bolt 26 to secure a mounting bracket 27 having a central aperture 28 dimensioned to receive the leg portion 24 of the vertical support member 20, opposed apertures (not shown) which intersect with the central aperture 28 and are dimensioned to receive the first locking bolt 26, and a downwardly depending apertured tab element 29 dimensioned to receive a conventional fastener such as a nail or the like to captively engage the vertical support member 20 to the upper end of a vertical wall 100.

Figure 3:
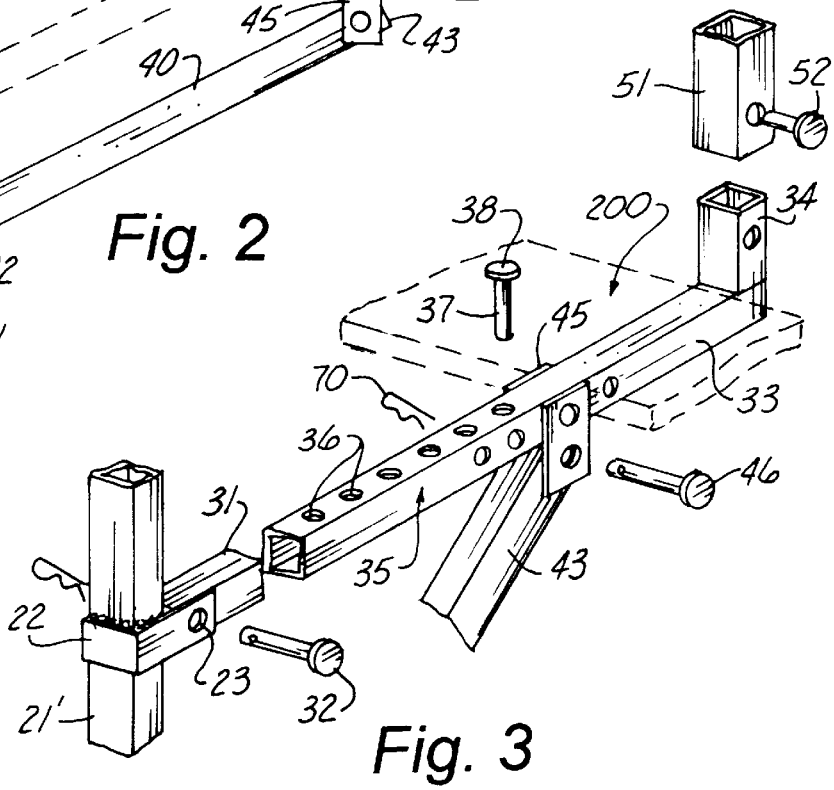
FIG. 3 is an exploded perspective view of the cross piece connection elements.
Figure 4:
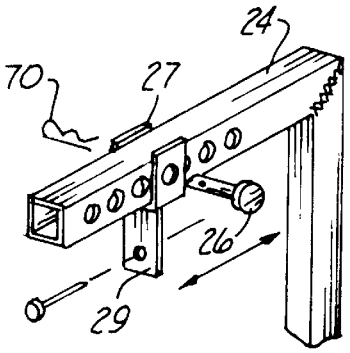
FIG. 4 is a perspective view of the wall capturing element.
Figure 5:
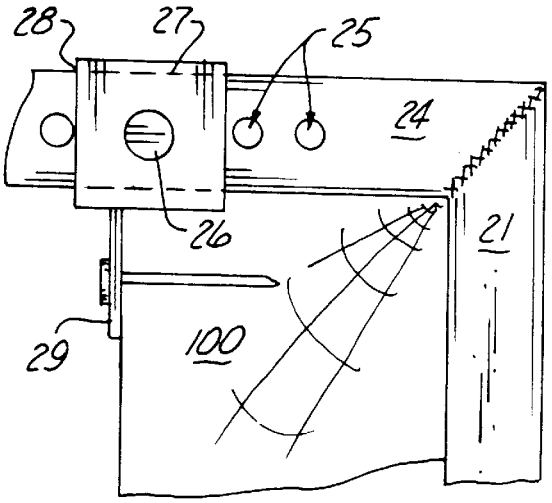
FIG. 5 is a side plan view of the wall capturing element.

Turning now to FIGS. 1 through 3, it can be seen that the lateral support unit 12 comprises in general, an elongated cross piece member 30 having an apertured inboard end 31 dimensioned to receive a second locking bolt 32, an outboard end 33 provided with an upwardly projecting apertured short post element 34, and an intermediate portion 35 whose upper surface is provided with a plurality of apertures 36 dimensioned to receive a third locking bolt 37 for captively engaging a scaffolding plank 200 on the top surface of the cross piece member 30.

In one version of the preferred embodiment illustrated in FIG. 3, the third locking bolt 37 is provided with a conventional enlarged head 38 that is normally sufficient to prevent lateral movement of the scaffolding plank 200 along the longitudinal axis of the cross piece member 30.

Figure 6:
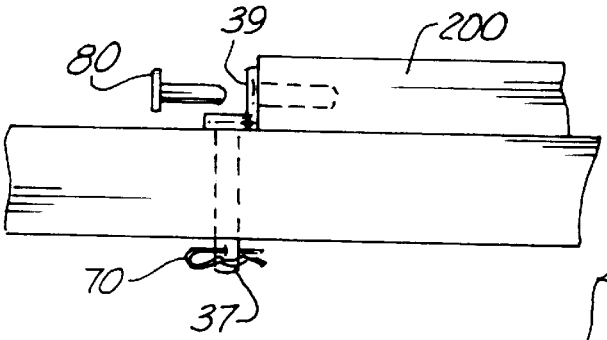
FIG. 6 is a side plan view of the scaffold plank immobilizing structure.
Figure 7:
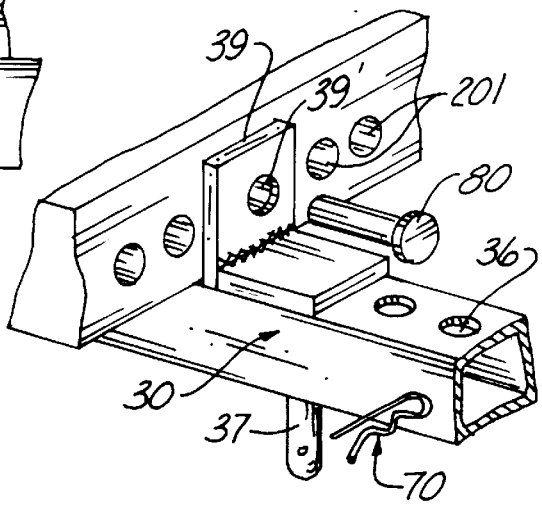
FIG. 7 is a perspective view of the plank immobilizing structure.

However, in another version of the preferred embodiment illustrated in FIGS. 6 and 7, the third locking bolt 37 is provided with an enlarged L-shaped head 39 having an aperture 39' dimensioned to receive a conventional fastener such as a nail or a bolt for preventing the lateral movement of the plank 200 transverse to the longitudinal axis of the cross piece member 30.

It should further be noted that in this particular version, the scaffolding plank 200 can be provided with a plurality of predrilled holes 201 to accept the conventional fastener or bolt 80 in a well recognized fashion.

Returning once more to FIGS. 1 through 3, it can be seen that the angled brace unit 13 comprises an elongated brace member 40 having an inboard end 41 pivotally secured by a fourth fastening bolt 42 to one of the vertically spaced brackets 22 on the vertical support member 20. The outboard end 43 of the brace member 40 is apertured and provided with a U-shaped suspension bracket 45 that is detachably connected to both the outboard end 33 of the cross piece member 30 and the outboard end 43 of the brace member 40 via a fifth locking bolt 46.

As can also be seen by reference to FIGS. 1 through 3, the railing support unit 14 comprises in general, an elongated vertical support post 50 whose lower end 51 is dimensioned to be connected to the short post element 34 on the cross piece member 30 via a sixth locking bolt 52 and whose upper end 53 is provided with a generally L-shaped bracket 54 dimensioned to receive a plank style railing element 90.

It should also be noted at this juncture that all of the locking bolts 26, 32, 46, etc., are designed to accept conventional fasteners 70 such as cotter pins, or the like to maintain the locking bolts in place in a well recognized fashion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A vertically adjustable wall supported scaffolding device for attachment to the upper end of a wall panel having a front surface, a rear surface, and a top, wherein the device comprises:

a vertical support unit including a generally inverted T-shaped vertical support member having a horizontal cross piece, and a vertical stem portion provided with a plurality of vertically spaced, generally C-shaped horizontally projecting brackets having opposed apertures formed on the outboard end of each bracket wherein the vertical stem is provided with a rearwardly extending leg portion dimensioned to fit over the top of said wall panel; wherein the rearwardly extending leg portion of the vertical support member is further provided with a mounting bracket slidably disposed on the leg portion and provided with a downwardly depending tab element adapted to engage the rear surface of the wall panel;

a vertically adjustable lateral support including an elongated cross piece member pivotally secured on one end to a selected one of said plurality of horizontally projecting brackets; and a brace unit including an elongated vertically adjustable brace member pivotally secured on one end to another selected one of said plurality of horizontally projecting brackets and connected on the other end to the other end of the cross piece member wherein said lateral support unit and said brace unit may be selectively secured to others of said plurality of vertically spaced horizontally projecting brackets to adjust the vertical point of attachment of the lateral support unit and the brace unit relative to the vertical stem portion of the vertical support member.

2. The device as in claim 1 wherein said mounting bracket is connected to said leg portion of the vertical support member.

3. The device as in claim 2 wherein the downwardly depending tab element is releasably engaged with the rear surface of the wall panel.

4. The device as in claim 1 further including:

a railing support unit disposed on the other end of the cross piece member.

5. The device as in claim 4 wherein said railing support unit includes an elongated vertical support post having a lower end connected to the other end of the cross piece member and having an upper end provided with a generally L-shaped bracket dimensioned to receive a railing element.

6. The device as in claim 1 wherein the other end of the cross piece member is provided with an upwardly extending post adapted to engage one side of a scaffolding plank.

7. The device as in claim 6 wherein the cross piece member has an intermediate portion which is provided with first means for preventing lateral movement of the scaffolding plank along the longitudinal axis of the cross piece member.

8. The device as in claim 7 wherein the intermediate portion of the cross piece member is further provided with second means for preventing lateral movement of the scaffolding plank transverse to the longitudinal axis of the cross piece member.

* * * * *